US011319120B2

(12) United States Patent
Lott et al.

(10) Patent No.: US 11,319,120 B2
(45) Date of Patent: May 3, 2022

(54) CAP FOR CLOSING AN OPENING OF A CONTAINER

(71) Applicant: KAO GERMANY GMBH, Darmstadt (DE)

(72) Inventors: Manfred Lott, Darmstadt (DE); Max Diecks, Darmstadt (DE)

(73) Assignee: KAO GERMANY GMBH, Darmstadt (DE)

( * ) Notice: Subject to any disclaimer, the term of this patent is extended or adjusted under 35 U.S.C. 154(b) by 96 days.

(21) Appl. No.: 16/765,739

(22) PCT Filed: Dec. 4, 2018

(86) PCT No.: PCT/EP2018/083530
§ 371 (c)(1),
(2) Date: May 20, 2020

(87) PCT Pub. No.: WO2019/110606
PCT Pub. Date: Jun. 13, 2019

(65) Prior Publication Data

US 2020/0290784 A1 Sep. 17, 2020

(30) Foreign Application Priority Data

Dec. 6, 2017 (EP) ..... 17205710

(51) Int. Cl.
*B65D 47/12* (2006.01)
*B65D 25/08* (2006.01)
(Continued)

(52) U.S. Cl.
CPC ..... *B65D 47/121* (2013.01); *B65D 25/085* (2013.01); *B65D 25/48* (2013.01); *B65D 55/024* (2013.01)

(58) Field of Classification Search
CPC .... B65D 47/121; B65D 25/085; B65D 25/48; B65D 55/024; B65D 43/0231;
(Continued)

(56) References Cited

U.S. PATENT DOCUMENTS 133,518 A * 12/1872 Burnap ..... B65D 41/06 215/332
235,279 A * 12/1880 Norton ..... B60K 15/0406 220/300
(Continued)

FOREIGN PATENT DOCUMENTS

CN 2281321 Y 5/1998
CN 1280543 A 1/2001
(Continued)

OTHER PUBLICATIONS

Search Report dated Dec. 18, 2018, in connection with PCT International Application No. PCT/EP2018/083530.
(Continued)

*Primary Examiner* — Vishal Pancholi
*Assistant Examiner* — Bob Zadeh
(74) *Attorney, Agent, or Firm* — Norris McLaughlin, P.A.

(57) ABSTRACT

It is provided a cap (10) for closing an opening (41) of a container (30), comprising a mainly tubular skirt (12), wherein the skirt (12) comprises a bayonet notch (26) for guiding a pin (28) of the container (30), wherein the skirt (12) comprises a guiding rim (38) running in axial direction and in circumferential direction towards the bayonet notch (26) for guiding the pin (28) of the container (30) into the bayonet notch (26). When the cap (10) is mounted to the container (30), the pin (28) may slide along the guiding rim (38) towards the bayonet notch (26) even at an originally
(Continued)

Figure 1:
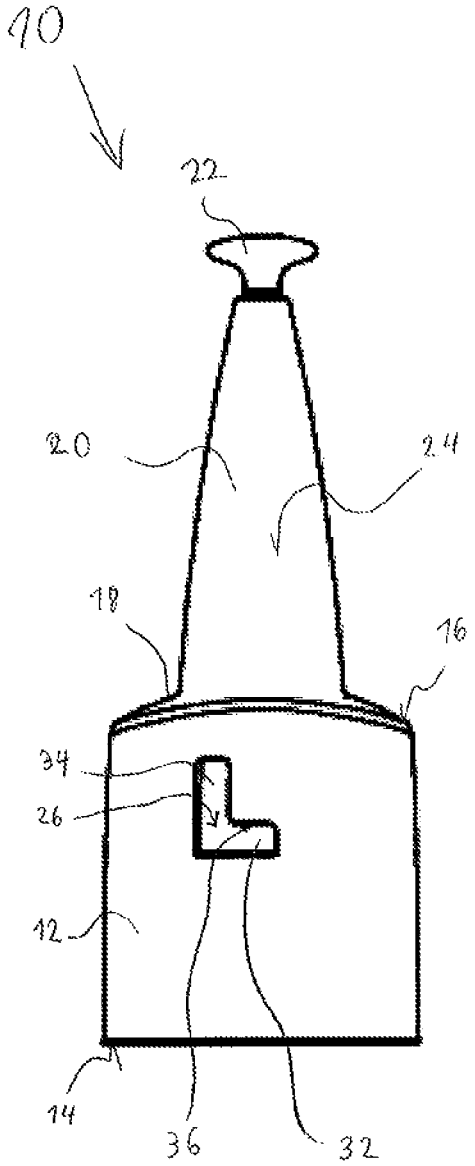

significant displacement in circumferential direction, so that a facilitated mounting of a cap (10) to a container (30) with a bayonet mount is enabled.

12 Claims, 3 Drawing Sheets

(51) Int. Cl.
*B65D 25/48* (2006.01)
*B65D 55/02* (2006.01)

(58) Field of Classification Search
CPC ..... B65D 39/10; B65D 41/06; B65D 41/36; B65D 45/00; B65D 47/125; B65D 47/145
See application file for complete search history.

(56) References Cited

U.S. PATENT DOCUMENTS 1,085,701 A * 2/1914 Richman ..... 43/120
1,341,592 A * 5/1920 Ruehle ..... A47J 27/004 220/300
1,549,618 A * 8/1925 Skoda ..... B65D 81/052 206/522
1,549,858 A * 8/1925 Evans ..... F16N 3/04 222/568
3,276,612 A * 10/1966 Caldwell ..... B65D 50/068 215/215
3,739,933 A * 6/1973 Degaetano ..... B65D 41/06 215/222
3,831,802 A * 8/1974 Chambers ..... F17C 13/06 220/300
4,434,903 A * 3/1984 Cooke ..... B65D 41/06 215/222
5,072,850 A * 12/1991 Gagnon ..... B65D 21/0233 220/300
5,437,382 A * 8/1995 Gluckman ..... B65D 50/067 215/204
5,845,814 A 12/1998 Nobbio
6,227,391 B1 5/2001 King
2005/0011894 A1* 1/2005 Eberle ..... B01L 3/50825 220/293
2020/0290784 A1* 9/2020 Lott ..... B65D 47/121

FOREIGN PATENT DOCUMENTS

CN WO-2009124490 A1 * 10/2009 ..... B65D 43/0231
DE 644112 C * 4/1937 ..... B65D 41/06
DE 66 10 680 U 7/1975
DE 10109671 C1 * 5/2002 ..... A61M 16/12
DE 102014205889 A1 * 10/2015 ..... F16B 21/04
EP 2 882 662 B1 6/2016
GB 2203729 A * 10/1988 ..... B65D 41/0471

OTHER PUBLICATIONS

Written Opinion in connection with PCT International Application No. PCT/EP2018/083530.

* cited by examiner

CAP FOR CLOSING AN OPENING OF A CONTAINER

This application is the U.S. National Stage of International Application No. PCT/EP2018/083530, filed Dec. 4, 2018, which claims foreign priority benefit under 35 U.S.C. § 119 of European Application No. 17205710.1 filed Dec. 6, 2017 the disclosures of which are incorporated herein by reference.

DESCRIPTION

The invention relates to a cap by means of which an opening of a container can be closed.

EP 2 882 662 B1 discloses a cap which can be connected to a container via a bayonet mount. The cap comprises a circumferential conical skirt, where a bayonet notch of the bayonet mount is provided.

DE 66 10 680 U discloses a cap with a pin which can be inserted into a L-shaped lower part of a notch of a container via an inclined upper part of the notch for guiding the pin into the L-shaped lower part of the notch.

There is a permanent need facilitating the mounting of a cap to a container.

It is the object of the invention providing measures enabling a facilitated mounting of a cap to a container.

The solution of the object is provided according to the invention by a cap according to the features of claim 1. Preferred embodiments of the invention are given by the dependent claims and the following description, which can constitute each solely or in combination an independent aspect of the invention.

According to the invention a cap for closing an opening of a container is provided comprising a mainly tubular skirt, wherein the skirt comprises a, particularly mainly L-shaped, bayonet notch for guiding a pin of the container, particularly as part of a push-and-turn-connection between the cap and the container, wherein the skirt comprises, particularly at its inside, a guiding rim running in axial direction and in circumferential direction towards the bayonet notch for guiding the pin of the container into the bayonet notch.

When the cap is mounted to the container, particularly a bottle, the cap can be moved in axial direction relative to the container. Due to the guiding rim a precise alignment of the cap relative to the container in circumferential direction is not necessary. The pin of the container may meet the guiding rim and can slide along the guiding rim to the intended position in circumferential direction where the pin can be inserted into the bayonet notch. When the pin should be misaligned in circumferential direction at the beginning of the axial relative movement, the correct alignment can be reached due to a turning of the cap, particularly during the axial relative movement forced by the sliding of the pin along the guiding rim. Since a correct alignment of the cap in circumferential direction with respect to the container is not important for mounting the cap to the container, the mounting is facilitated. The design of the cap enables a mounting by mass-production so that the production costs can be reduced. When the cap is mounted to the container, the pin may slide along the guiding rim towards the bayonet notch even at an originally significant displacement in circumferential direction, so that a facilitated mounting of a cap to a container with a bayonet mount is enabled.

The bottom side of the skirt of the cap may point downwards in mounted state, when the container is placed onto a horizontal ground and the opening of the container points upwards. The skirt may comprise a top side pointing in the opposite axial direction than the bottom side, wherein the top side may be closed and/or may comprise an outlet for discharging the content of the container. Particularly the skirt may be formed like a circular ring, wherein preferably a wall thickness of the skirt is small with respect to the diameter. Preferably the skirt comprises a constant outer diameter. The cap may be made from a plastic material, particularly a thermoplastic material. The bayonet notch may be provided by a deepening in the material of the skirt, so that the bayonet notch cannot be seen from the outside. In the alternate the bayonet notch may be provided by a through hole, particularly by a slot extending in circumferential direction along a part of the circumference of the skirt and a slot extending in axial direction along a part of the axial extension of the skirt, wherein the slots are connected with each other. The guiding rim may comprise a constant inclination with respect to an axial middle axis of the skirt. In the alternate the guiding rim comprise several interconnected guiding rim parts comprising a different inclination with respect to the axial middle axis of the skirt. The guiding rim may be formed helically. The guiding rim may be provided by a protruding rib and/or a step in the material of the skirt. The pin of the container may protrude in radial direction from an outside or an inside of the container. Correspondingly the skirt may be provided radially outside or radially inside a container wall of the container. The cap may comprises a further skirt radially inside or outside the container, so that the container wall of the container may be inserted between the skirt and the further skirt. The pin may be formed like a cylindrical bolt. In the mounted state of the pin inside the cap the pin may abut a border of the bayonet notch. Particularly the axial relative movement of the pin is blocked in the intended mounted state.

The bayonet notch may be formed like a L provided in the material of the skirt. The pin and the bayonet notch may provide a bayonet mount in the assembled state. The bayonet notch may be adapted for providing an mainly axial relative movement of the cap relative to the container by means one part of the bayonet notch and a turning of the cap relative to the container by means another part of the bayonet notch. When the pin is inserted into the bayonet notch the container may be opened and closed by a push-and-turn-movement of the cap relative to the container while the pin is guided in the particularly mainly L-formed bayonet notch. The pin and the bayonet notch provide a push-and-turn-connection commonly referred to as "bayonet closure" or "bayonet mount". The bayonet notch may be adapted to form a part of a push-and-turn-connection between the cap and the container, wherein the push-and-turn-connection may be established by inserting the pin into the bayonet notch. The forming of the bayonet notch may be similar to the forming of a bayonet. For example, the bayonet notch may comprise a blocking notch running mainly in circumferential direction providing a locking surface for the pin and an opening notch running mainly in axial direction providing a cam surface for the pin. In the alternate it is possible that the blocking notch and the opening notch are aligned to each other by an angle different to 90°, for example differing from 90° by 1° to 20°. In the alternate it is possible that the blocking notch is aligned to the tangential direction by an angle, for example of 1° to 20°. In the alternate it is possible that the opening notch is aligned to the axial direction by an angle, for example of 1° to 20°. The alignment of the blocking notch and the opening notch can be adapted to the ergonomic needs of a user for opening and closing the container by hand. Particularly the bayonet notch is formed for locking, particularly clipping, the pin at one or both terminal ends of the bayonet notch.

Particularly a further guiding rim running in axial direction and in circumferential direction towards the bayonet notch for guiding the pin of the container into the bayonet notch is provided, wherein the guiding rim and the further guiding rim are arranged funnel-shaped to each other. The guiding rim and the further guiding rim may be arranged like a V for forming a funnel towards the bayonet notch. The further guiding rim may be formed mirror-inverted with respect to the guiding rim. When the pin of the container is offset in the one circumferential direction, the pin may meet the guiding rim during mounting, and when the pin of the container is offset in the opposite circumferential direction, the pin may meet the further guiding rim during mounting, so that the correct alignment in circumferential direction can be reached from different directions. Due to the plurality of guiding rims, particularly two guiding rims for each bayonet mount, a steep inclination for the guiding rims can be provided and/or a short extension of the skirt in axial direction can be realized. A resistance against the axial relative movement during mounting can be reduced by means of a steep inclination of the guiding rim.

Preferably the guiding rim and/or the further guiding rim runs from a bottom side of the skirt to the bayonet notch. When the pin should be misaligned in circumferential direction at the beginning of the axial relative movement of the cap relative to the container, the correct alignment can be reached automatically due to the turning of the cap during the axial relative movement forced by the sliding of the pin along the guiding rim. Particularly the mounting can be easily automatized and performed by a corresponding machine. This machine simply has to put the cap onto the container and to apply an axial force downwards, while allowing a turning of the cap during the axial relative movement.

Particularly preferred the sum of all guiding rims are arranged over a circumferential angle $\alpha$ of nearly 360°, particularly $350° \leq \alpha \leq 360°$. Irrespectively of the circumferential relative position of the pin in the unmounted state with respect to the intended position in the mounted state the cap can be turned into the correct circumferential position during the axial relative movement in the mounting step. Particularly the only circumferential angle, where no guiding rim is provided, is the circumferential angle occupied by the pin in the mounted state.

In a preferred embodiment the guiding rim and/or the further guiding rim runs from the bayonet notch to a an axial stop rim or from the bayonet notch to a circumferential stop rim, wherein particularly the circumferential stop rim is provided by means of an axially running rib comprising an extension in circumferential direction, which is smaller than an extension in circumferential direction of the pin. The axial stop rim may block a movement of the pin in axial direction. The axial stop rim may run in circumferential direction. The circumferential stop rim may block a movement of the pin in circumferential direction. The axial circumferential rim may run in axial direction. The axial stop rim and/or the circumferential stop rim may be provided at the inside of the skirt. The circumferential stop rim may block an overrunning the bayonet notch by the pin when the cap is turned. The mounting may be facilitated. When the pin meets the circumferential stop rim when the cap is put on the container, the circumferential stop rim is too small in circumferential direction for blocking the axial relative movement of the cap relative to the container. The pin may pass the circumferential stop rim either at the one circumferential side or the other circumferential side due to the axial force applied to the cap. Due to the axial stop rim the cap may be put onto the container first so that a part of the axial extension of the cap is already put onto the container when the pin meets one of the rims at the inside of the skirt. A first centering of the cap onto the container may be already present, when the pin meets one of the rims the first time. The pin may slide along the axial stop rim in circumferential direction only when the cap is turned until the guiding rim and/or the further guiding rim is met, so that the part of a helical movement of the cap is reduced. Further the guiding rim and/or the further guiding rim may comprise a quite steep inclination. The automatic mounting of the cap to the bottle by means of a machine can be facilitated.

Particularly the guiding rim is provided by a difference in the wall thickness of the skirt, wherein particularly the whole area of the skirt between the guiding rim and the bottom side of the skirt comprises a smaller wall thickness than the area of the skirt between the guiding rim and a top side of the skirt. Preferably the material of the skirt is more elastic and/or more deformable than the material of the pin. Due to the smaller wall thickness the area where the pin may be pressed along the inside of the skirt is more flexible and/or elastic than the part of the skirt with the bigger wall thickness. One the one hand the pin can be moved easily along the inside of the skirt due to the small thickness, but on the other hand the pin cannot be unmovable clamped inside the skirt, since the step-like guiding rim at the transition between the small wall thickness and the big wall thickness prevents that the pin reaches the area of the skirt with the bigger wall thickness. Particularly the bayonet notch may positioned far away from the bottom side of the skirt. Due to the flexibility of the skirt in the area with the small wall thickness the pin can be moved along a long axial way along the inside of the skirt without blocking.

Preferably the whole bayonet notch is bordered by the material of the skirt. The bayonet notch does not comprise a slot or other through hole by which the pin may reach the bayonet notch during mounting. When the pin is inserted into the bayonet notch, the pin may not leave the bayonet notch anymore, so that the cap is loss-proof connected to the container. It is prevented that the cap fall apart from the container.

Particularly preferred the bayonet notch comprises a blocking notch running mainly in circumferential direction for guiding the pin of the container between a blocked position, where a movement of the pin in axial direction is blocked, and an unblocked position, where the movement of the pin in axial direction is enabled, and an opening notch running mainly in axial direction for guiding the pin of the container between the unblocked position and an opening position, wherein the guiding rim terminates at a circumferential position of the blocking notch for guiding the pin of the container into the blocked position. The pin could be positioned also in the opening notch when poisoned in the unblocked position. The pin may be moved inside the opening notch between the unblocked position, where the pin is movable in axial direction but the container is still closed, and the opening position, where the container is opened. The guiding rim may guide the pin at a position inside the blocking notch maximum far away from the opening notch. When the pin meets the blocking notch a further axial relative movement can be blocked by the edge of the blocking notch. An unintended moving of the cap into the opened position during mounting the cap to the container can be prevented.

Particularly the bayonet notch comprises a blocking notch running mainly in circumferential direction for guiding the pin of the container between a blocked position, where a movement of the pin in axial direction is blocked, and an unblocked position, where the movement of the pin in axial direction is enabled, and an opening notch running mainly in axial direction for guiding the pin of the container between the unblocked position and an opening position, wherein a blocking latch protrudes into the blocking notch for keeping the pin of the container in the blocked position, wherein particularly the blocking latch is adapted to be sheared off by the pin by means of an actuation force in circumferential direction above a predefined threshold. The pin could be positioned also in the opening notch when poisoned in the unblocked position. The pin may be moved inside the opening notch between the unblocked position, where the pin is movable in axial direction but the container is still closed, and the opening position, where the container is opened. The blocking latch may keep the pin mainly unmovable in the blocked position. An unintended opening of the container may be prevented. However, when a sufficient force is applied, the pin may pass the notch and reach the opening notch. The blocking latch ensures that the container is only opened intentionally. The blocking notch may provide a press fit of the pin inside the blocking notch and/or a form-fit blocking. If so, the blocking latch can be cut off from the blocking notch, when the pin overcome the blocking latch. The blocking latch may be formed like a protruding nose. Particularly the blocking latch protrudes in axial direction. Particularly preferred the blocking latch forces a sound, particularly a clicking-sound, when the pin passes the blocking latch. The sound provides an acoustic signal indicating that the container is not secured in the blocked state anymore and ready to be opened.

Preferably the bayonet notch comprises a blocking notch running mainly in circumferential direction for guiding the pin of the container between a blocked position, where a movement of the pin in axial direction is blocked, and an unblocked position, where the movement of the pin in axial direction is enabled, and an opening notch running mainly in axial direction for guiding the pin of the container between the unblocked position and an opening position, wherein the opening notch comprises at least one ramp for blocking a movement of the pin, particularly for blocking a movement of the pin back towards the unblocked position. The pin could be positioned also in the opening notch when poisoned in the unblocked position. The pin may be moved inside the opening notch between the unblocked position, where the pin is movable in axial direction but the container is still closed, and the opening position, where the container is opened. The ramp of the opening notch may interact with a counter-ramp of the pin. The ramp may provide a press fit at the smallest distance inside the opening notch, which, is so, can be overcome by the pin by sliding along the inclined face of the ramp. After passing the ramp the ramp may provide a stop face blocking a movement back of the pin inside the opening notch. Due to the stop face the movement of the pin is blocked not only by friction but by a positive-fit. The container can be opened by moving the cap such that the pin is moved from the unblocked position in the opened position but the container cannot be closed again after the container is opened once. Particularly when the container contains reactive components, particularly a hair tinting means or the like, it can be prevented that accidentally an old content of an already used container is applied. A user can see immediately whether a particular container is unused and comprises a fresh content with particular wanted known properties.

Particularly preferred the bayonet notch is provided by a through hole in the skirt. The position of the pin inside the bayonet notch can be easily recognized by a user facilitating the handling of the cap, when the container should be opened.

Particularly a top side of the skirt is closed by a cover, wherein particularly the cover comprises a nozzle for discharging a content of the container. The cover may close the opening of the container. When the cap is displaced in axial direction the cover may be lift from the opening so that the content of the container may leave the container via the opened opening and can be discharged via an orifice of the cap located in the skirt of the cap. Particularly the cover comprises a nozzle with an orifice, wherein the orifice is closed by a closure part which can be sheared off from the nozzle via a predefined breaking line for opening the orifice. In a preferred embodiment the movability of the cap in axial direction relative to the container can be preferably used for initiating a mixing of two different fluids inside the container. This means a connection channel between two compartments of the container with two different fluids may be opened in the opened position of the pin inside the bayonet notch but not necessarily the opening of the container is opened for discharging the content of the container. An example of a suitable container is described in WO 2014/090776 A1 which content relating to the design of the container is herewith incorporated by reference as part of the invention.

Preferably the nozzle comprises two opposing, particularly flattened, actuation faces for turning the nozzle by means of a plurality of fingers, wherein particularly the forming of the actuation faces is adapted to the forming of the finger, wherein the nozzle comprises at its middle of its height in axial direction, particularly along its mainly whole height, a largest extension S in radial direction and a smallest extension s in radial direction, wherein particularly $0.80 \leq s/S \leq 0.99$, preferably $0.90 \leq s/S \leq 0.98$ and particularly preferred $s/S = 0.95 \pm 0.02$ applies. The actuation faces may provide an ergonomic form fit adapted to the curvature of the finger in order to enable a turning of the cap by means of two or three fingers. The actuation faces may be even or concave or convex. The nozzle may comprise not a circular flow cross-section but a more slot-like or oval flow cross-section. The actuation faces provide places where a user would put his fingers intuitively for turning the cap. In contrast to a circular or conical nozzle the fingers transfer the forces for turning the cap not only via friction. The actuation faces provides a force transmission point more spaced to a turning axis of the cap so that a higher turning moment can be introduced particularly even with a smaller actuation force. The handling of the cap for opening the packaging is facilitated. The nozzle may comprise a mainly oval or elliptic cross section along a radial plane. The largest extension S may be the major axis of the mainly elliptic outer surface of the nozzle and the smallest extension s may be the minor axis of the mainly elliptic outer surface of the nozzle.

A further aspect of the invention is directed to a packaging for storing and/or mixing fluids, comprising a container for storing a first fluid, wherein the container comprises a pin protruding in radial direction, and a cap, which may be designed as previously described, for covering an opening of the container, wherein the pin of the container is inserted into the bayonet notch, wherein particularly the skirt of the cap is more deformable than the pin of the container. When the cap is mounted to the container, the pin may slide along the guiding rim towards the bayonet notch even at an originally significant displacement in circumferential direction, so that a facilitated mounting of a cap to a container with a bayonet mount is enabled. When a specific force is applied in radial direction a deformation of the skirt may be larger than a deformation of the pin. The pin may be stiffer than the skirt. The thickness of the pin in radial direction may by thicker than the thickness of the skirt in radial direction. Particularly the pin may comprise a higher elastic modulus E than the skirt. However, the different deformations of the pin and the skirt can be also provided, when using the same material for the container and the skirt, by its different forming alone, which leads to a different stiffness of the pin and the skirt, particularly due to its different cross sectional areas perpendicular to the radial direction.

Particularly preferred the container comprises a radial protrusion for providing a mechanical resistance against a turning of the cap for keeping the pin in a blocked position inside the bayonet notch, wherein particularly the protrusion provides a sound when overridden by a rim of the cap particularly by the circumferential stop rim. The protrusion may force a sound, particularly a clicking-sound, when one of the rims passes the protrusion. The sound provides an acoustic signal indicating that the container is not secured in the blocked state anymore and ready to be opened. The protrusion may be positioned sufficiently displaced in axial direction with respect to the cap, that no rim passes the protrusion while the cap is turned before the pin is inserted into the bayonet notch. When the cap is turned is in the mainly correct position for inserting the pin into the bayonet notch, the protrusion is axially displaced to the corresponding rim, particularly the circumferential stop rim. After inserting the pin into the bayonet notch by means of an relative movement in axial direction the protrusion and the corresponding rim may be placed at least partially in the same axial area. When the pin is moved from the blocked position into the unblocked position by turning the cap relative to the container, the corresponding rim also moves in circumferential direction relative to the protrusion so that the rim meets the protrusion and is pressed over the protrusion passing the protrusion, particularly while performing a clicking-sound. Particularly preferred the circumferential stop rim not only provides a circumferential stop but also secures the pin in the blocked position inside the bayonet notch and even more provides an acoustic signal signaling the unblocked state of the packaging.

Particularly the container comprises at least one centering element for centering a lower part of the skirt of the cap. Preferably the centering element extends in circumferential direction and/or a plurality of centering elements is arranged in circumferential direction one after another. The centering element may comprise a centering chamfer comprising a centering face inclined with respect to the axial direction of the cap. When the cap is put onto the container an edge of the bottom side of the skirt may rest on the centering face of the centering element. When the cap is pressed in axial direction for inserting the pin into the bayonet notch, the lower part of the skirt may be pressed over the centering element(s) so that the cap is automatically centered. Particularly preferred at least two centering elements are spaced to each other in circumferential direction, wherein the radial protrusion of the container for providing a mechanical resistance against a turning of the cap is arranged between these two centering elements particularly at mainly the same axial area. When the pin is pressed into the bayonet notch, the circumferential stop rim or another rim may be moved between a circumferential gap between the protrusion and one of the neighboring centering elements. When the pin is turned from the blocked position into the unblocked position the rim passes the protrusion and is located in a circumferential gab between the protrusion and the other neighboring centering element so that the cap can be moved in axial direction from the unblocked position into the opened position.

Particularly preferred the container comprises a neck spaced to the opening of the container, wherein the flow cross-section of the neck is closed by a plug, wherein the cap comprises a rib for pushing the plug out of the neck, wherein the skirt of the cap is arranged radially outside the container and the rib is arranged radially inside the container. Particularly the neck comprises a smaller flow cross-section than the opening of the container. A collar of the container may be received by a cavity of the cap provided between the skirt and the rib, so that an axial guiding of the cap at the container is improved. The rib can push the plug out of the neck in the opened position, wherein the plug may fall into the lower compartment of the container or may be retained in the neck by means of a radially protruding part of the plug. An example of a suitable plug is described in WO 2014/090776 A1 or in WO 2015/177165 A1 which content relating to the design of the plug is herewith incorporated by reference as part of the invention.

Particularly a second fluid is provided inside the container, wherein the second fluid is arranged spaced to the first fluid by the plug. When the plug is pushed out of the neck the second fluid may flow via the neck towards the first fluid, where the fluids can be mixed.

Preferably the bayonet notch comprises a blocking notch running mainly in circumferential direction for guiding the pin of the container between a blocked position and an unblocked position and an opening notch running mainly in axial direction for guiding the pin of the container between the unblocked position and an opening position, wherein the pin comprises a counter-ramp for blocking a movement of the pin, particularly for blocking a movement of the pin back towards the unblocked position. The counter ramp can be positioned at a place spaced to the guiding rim so that the counter-ramp cannot dig into the material of the guiding rim during mounting.

The counter-ramp of the pin may interact with a ramp of the opening notch. The counter-ramp may slide along the opening notch in a direction from the unblocked position towards the opening position. When the pin is moved in the opposite axial direction towards the unblocked position, the counter-ramp may block onto the corresponding ramp of the opening notch and/or dig into the material of the opening notch. The counter-ramp may provide a stop face blocking a movement back of the pin inside the opening notch. The container can be opened by moving the cap such that the pin is moved from the unblocked position in the opened position but the container cannot be closed again after the container is opened once. Particularly when the container contains reactive components, particularly a hair tinting means or the like, it can be prevented that accidentally an old content of an already used container is applied. A user can see immediately whether a particular container is unused and comprises a fresh content with particular wanted known properties.

Figure 2:
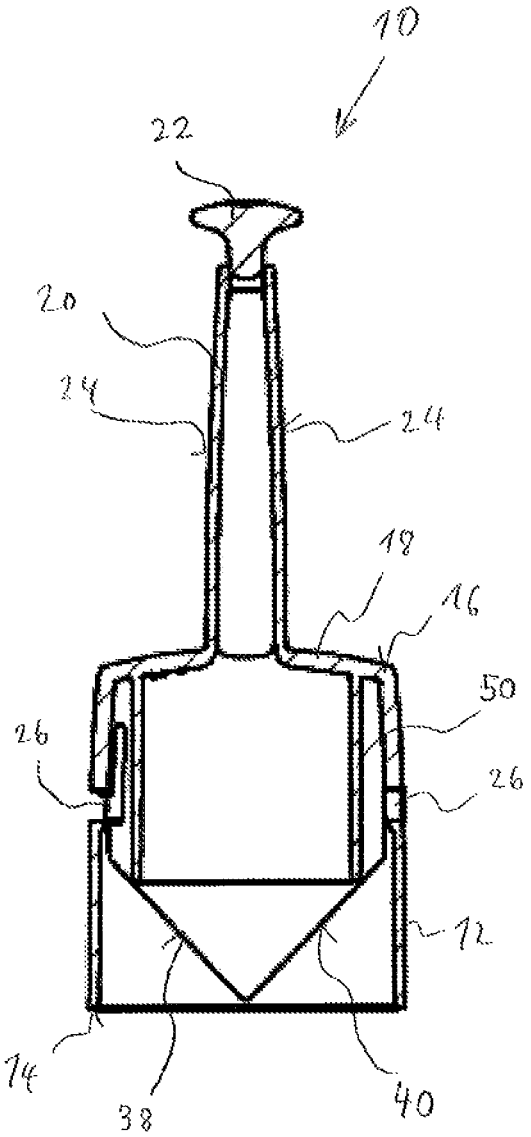
Figure 3:
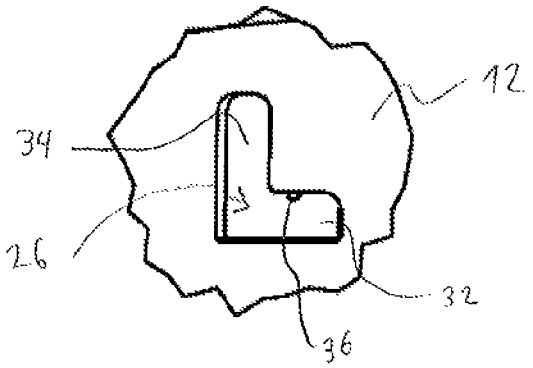
Figure 4:
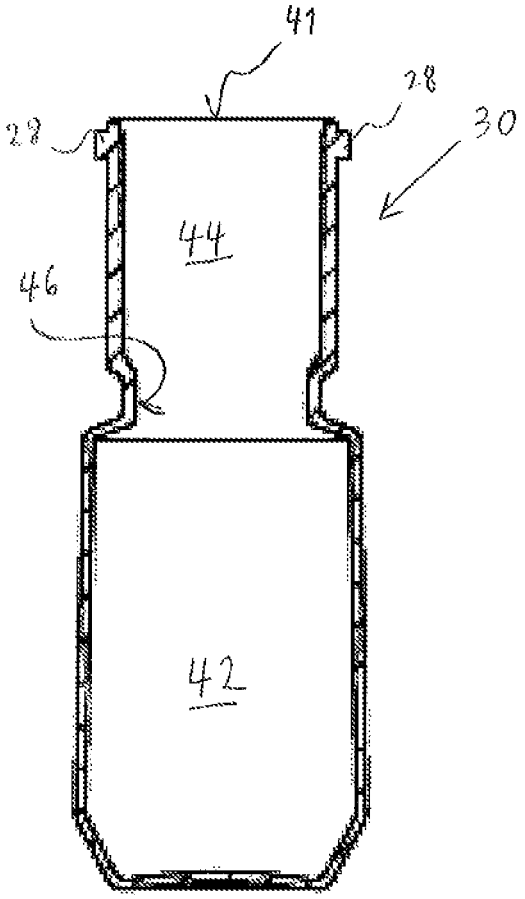

These and other aspects of the invention will be apparent from and elucidated with reference to the embodiments described hereinafter, wherein the described features can constitute each solely or in combination an independent aspect of the invention. In the drawings:

FIG. 1: is a schematic side view of a first embodiment of a cap,

FIG. 2: is a schematic cross sectional view rotated 90° of the cap of FIG. 1, FIG. 3: is a schematic detailed view of the cap of FIG. 1, FIG. 4: is a schematic cross sectional view of a first embodiment of a container for the cap of FIG. 1

Figure 5:
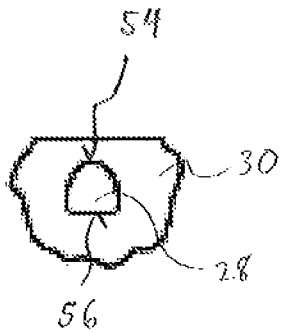
Figure 6:
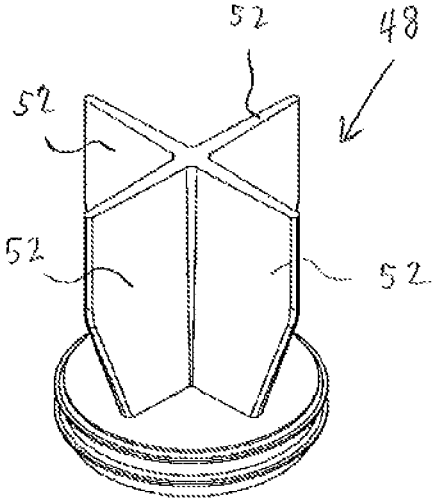
Figure 7:
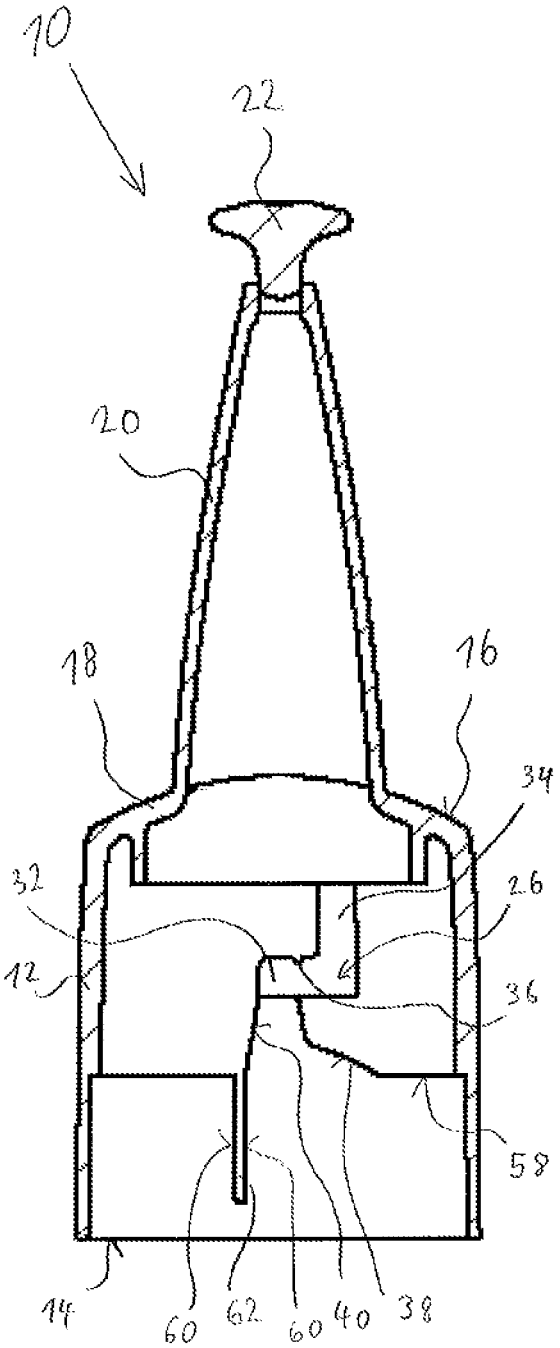
Figure 8:
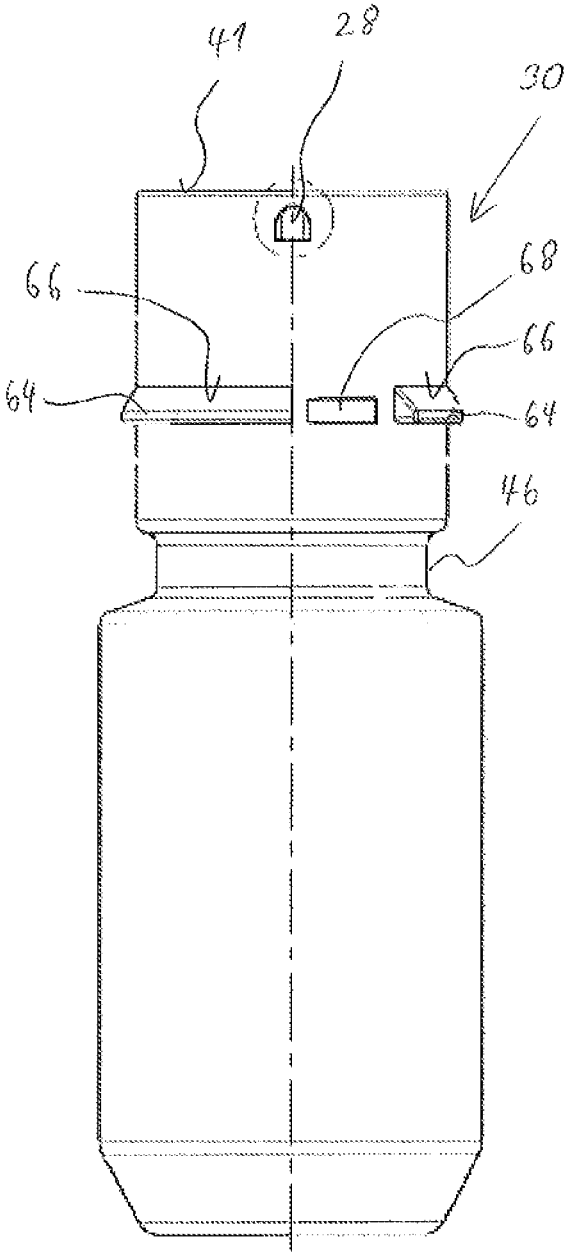

FIG. 5: is a schematic detailed view of the container of FIG. 4,

FIG. 6: is s schematic perspective view of a plug for the container of FIG. 4, FIG. 7: is a schematic cross sectional side view of a second embodiment of a cap and FIG. 8: is a schematic cross sectional view of a second embodiment of a container for the cap of FIG. 7.

The cap 10 illustrated in FIG. 1 and FIG. 2 comprises a ring cylindrical skirt 12 with a bottom side 14 and a top side 16. The top side 16 is closed by a cover 18 which comprises a nozzle 20. An orifice of the nozzle 20 is closed by a closure 22, wherein the closure 22 may be one-piece with the nozzle 20 and connected to the nozzle 20 via a breaking line, where the closure 22 may be sheared off from the nozzle 20 for opening the orifice of the nozzle 20. The nozzle 20 is flattened and comprises two flat actuation faces 24, by which the cap 10 can be easily turned by hand.

The skirt 12 of the cap 10 comprises a bayonet notch 26 into which a pin 28 of a container 30 can be inserted for providing a bayonet mount. The bayonet notch 26 comprises a blocking notch 32 running along a part of the circumference of the skirt 12 and an opening notch 34 running along a part of the axial extension of the skirt 12, so that the bayonet notch 26 is designed like a L. The end of the blocking notch 32 positioned away from the opening notch 34 defines a blocked position of the pin 28 in the blocking notch 32. The joint end of the blocking notch 32 and the opening notch 34 defines an unblocked position of the pin 28 in the bayonet notch 26. The end of the opening notch 34 positioned away from the blocking notch 32 defines an opened position of the pin 28 in the opening notch 34. As illustrated particularly in FIG. 3 the blocking notch 32 may comprise a blocking latch 36 radially protruding into the blocking notch 32 for keeping the pin 28 in the blocked position. The blocking notch 32 may provide a press fit for the pin 28 which can be overcome by a sufficient high actuation moment for turning the cap 10 relative to the pin 28. Particularly the blocking latch 36 may be sheared off from the skirt 12 when a a sufficient high actuation moment for turning the cap 10 relative to the pin 28 is applied.

As illustrated in FIG. 2 a guiding rim 38 is provided at the inside of the skirt 12. When the cap 12 is mounted to the container 30 by a relative axial movement, the pin 28 may meet the guiding rim 38 and turns the cap 10 in the intended relative position in circumferential direction automatically during the relative axial movement. The guiding rim 38 runs in circumferential direction and in axial direction and terminates at the blocking notch 32 such, that the pin 28 automatically is positioned into the blocking position inside the blocking notch 32 without damaging the blocking latch 34. The blocking notch 32 blocks a further relative axial movement and indicates the end of the mounting step for mounting the cap 10 to the container 30. Particularly, a further guiding rim 40 is provided for guiding the pin 28 towards the blocking notch 32 by turning the cap 10 in an opposite circumferential direction than the guiding rim 38. The guiding rim 38 and the mirror-inverted formed further guiding rim 40 may be arranged like a V, so that the guiding rim 38 and the further guiding rim 40 may form a funnel for directing the pin 28 into the intended mounting position. In the illustrated embodiment two bayonet notches 26 are provided for two different pins 28 arranged opposing to each other, wherein a pair of guiding rim 38 and further guiding rim 40 is provided for each bayonet notch 26. The guiding rim 38 and the further guiding rim 40 is provided by a step at the inside of the skirt 12. For that reason the skirt 12 comprises a smaller wall thickness below the guiding rim 38 and the further guiding rim 40 than above the guiding rim 38 and the further guiding rim 40 as illustrated in FIG. 2.

As illustrated in FIG. 5 the pin 28 my comprise a rounded upper head 54 so that only a small contact surface is provided between the pin 28 and the guiding rim 38 or the further guiding rim 40. Further the pin 28 may comprise a flat base 56 so that an enlarged contact surface is provided between the pin 28 and the lower edge of the blocking notch 32. A tilting of the cap 10 relative to the pin 28 and the container 30 can be prevented.

The container 30 as illustrated in FIG. 4 can be designed as a bottle for mixing two separated fluids. The pins 28 are provided at the outside of the container 30 close to an opening 41 of the container 30 and protrude radially outwards. The container 30 may comprise a lower compartment 42 for storing a first fluid and an upper compartment 44 for storing a second fluid connected via a neck 46 which can be closed by a plug 48 as illustrated in FIG. 6. When the cap 10 is turned from the blocked position in the unblocked position, the cap 10 can be pushed downwards so that a particularly tubular rib 50 may meet the plug 48 and press the plug 48 out of the neck 46. Further a tilting of the cap 10 can be prevented by inserting a part of the container 30 into a circumferential slot provided between the skirt 12 of the cap 10 and the rib 50 of the cap 10. For that reason the rib 50 may extend below the level of the bayonet notch 26.

As illustrated in FIG. 6 the plug 48 may comprise retainer ribs 52 which provides a stop for the rib 50 of the cap 10 on the one hand and prevents the plug 48 from falling completely into the lower compartment 42 on the other hand. The radial extension of two opposing retainer ribs 52 may be bigger than the diameter of the neck 46. When the plug 48 does not seal the neck 46 anymore the second fluid can flow from the upper compartment 44 into the lower compartment 42 where both fluids can be mixed, particularly for providing a reactive liquid hair tinting means. The mixture can be discharged via the nozzle 20 of the cap 10.

The guiding rim 38 of the embodiment of the cap 10 illustrated in FIG. 7 starts not at the bottom side 14 of the skirt 12 but at an axial stop rim 58 compared to the embodiment of the cap 10 illustrated in FIG. 1 and FIG. 2. Further the guiding rim 38 comprises two parts with a different inclination. The axial stop rim 58 terminates at a circumferential stop rim 60 which is provided as a slim axially running rib 62 protruding axially downwards from the axial stop rim 58 close but spaced to the bottom side 14 of the skirt. The further guiding rim 40 starts at the upper end of the circumferential stop rim 60.

The container 30 illustrated in FIG. 8 comprises centering elements 64 extending in circumferential direction compared to the embodiment illustrated in FIG. 4. Each centering element 64 comprises a chamfer 66 inclined with respect to the axial direction for centering a lower part of the skirt 12. When the cap 10 is put onto the container 30, the pin 28 may meet the axial stop rim 58. Then the cap 10 can be turned so that the pin 28 can be guided by means of the guiding rim 38 and/or the further guiding rim 40 towards the bayonet notch 26. When the pin 28 is pressed into the bayonet notch 26, the cap 10 is centered at the same time by means of the centering elements 64 onto which the lower part of the skirt 12 is pressed. At the same time the axially running rib 62 of the circumferential stop rim 60 is positioned between a radial protrusion 68 of the container 30 and one of the neighboring centering elements 64. The axially running rib 62 of the circumferential stop rim 60 is blocked in circumferential direction between the protrusion 68 and the neighboring centering element 64, so that the pin 28 is blocked in its blocked position at the same time. When the pin 28 should be turned from the blocked position into the unblocked position, the circumferential stop rim 60 has to be pressed over the protrusion 68 so that the circumferential stop rim 60 overruns the protrusion 68 and overcomes the mechanical resistance of the protrusion 68. For that reason the protrusion 68 protrudes such far in radial direction for providing a press fit with the axially running rib 62 of the circumferential stop rim 60. The centering elements 64 may protrude farther than the protrusion 68 so that the circumferential stop rim 60 may not overrun the centering elements 64. When the pin 28 reaches the unblocked position the axially running rib 62 of the circumferential stop rim 60 reaches a gap between the protrusion 68 and the other neighboring centering element 64, wherein the overrunning of the protrusion 68 leads to a clicking-sound signaling that the unblocked state is reached.

The invention claimed is:

1. A cap for closing an opening of at least one container, the cap comprising:

a mainly tubular skirt that comprises a bayonet notch for guiding a pin of a container, wherein the bayonet notch is L-shaped for providing a mainly axial relative movement of the cap relative to the container by means of a first part of the bayonet notch and a turning of the cap relative to the container by means of a second part of the bayonet notch, wherein the mainly tubular skirt further comprises a first guiding rim running in an axial direction and in a circumferential direction towards the bayonet notch for guiding the pin of the container into the bayonet notch, wherein a second guiding rim is provided that runs in the axial direction and in the circumferential direction towards the bayonet notch for guiding the pin of the container into the bayonet notch, wherein the first guiding rim and the second guiding rim are arranged funnel-shaped to each other.

2. The cap of claim 1, wherein at least one of the first guiding rim and the second guiding rim runs from a bottom side of the mainly tubular skirt to the bayonet notch.

3. The cap of claim 1, wherein the bayonet notch comprises:

a blocking notch running mainly in the circumferential direction for guiding the pin of the container between (i) a blocked position, where movement of the pin in the axial direction is blocked, and (ii) an unblocked position, where movement of the pin in the axial direction is enabled; and an opening notch running mainly in the axial direction for guiding the pin of the container between (ii) the unblocked position and (iii) an opening position, wherein the guiding rim terminates at a circumferential position of the blocking notch for guiding the pin of the container into (i) the blocked position.

4. The cap of claim 1, wherein the bayonet notch comprises:

a blocking notch running mainly in the circumferential direction for guiding the pin of the container between (i) a blocked position, where movement of the pin in the axial direction is blocked, and (ii) an unblocked position, where movement of the pin in the axial direction is enabled; and an opening notch running mainly in the axial direction for guiding the pin of the container between (ii) the unblocked position and (iii) an opening position, wherein a blocking latch protrudes into the blocking notch for keeping the pin of the container in (i) the blocked position, wherein the blocking latch is adapted to be sheared off by the pin by means of an actuation force in the circumferential direction above a predefined threshold.

5. The cap of claim 1, wherein a top side of the mainly tubular skirt is closed by a cover, wherein the cover comprises a nozzle for discharging a content of the container.

6. The cap according to claim 5, wherein the nozzle comprises two opposing actuation faces for turning the nozzle by means of a plurality of fingers, wherein forming of the actuation faces is adapted to forming of at least one finger, wherein at a middle of the nozzle, a comprises a height of the nozzle in the axial direction comprises a first extension in a radial direction and a second extension in the radial direction, wherein a ratio of the second extension to the first extension equals 0.95±0.02.

7. A packaging for storing and/or mixing fluids, the packaging comprising:

the container for storing a first fluid and comprising the pin protruding in a radial direction; and the cap according to claim 1 for covering the opening of the container, wherein the pin of the container is insertable into the bayonet notch, wherein the mainly tubular skirt of the cap is more deformable than the pin of the container.

8. The packaging of claim 7, wherein the container further comprises a radial protrusion for providing a mechanical resistance against a turning of the cap for keeping the pin in a blocked position inside the bayonet notch, wherein the protrusion provides a sound when overridden by a rim of the cap.

9. The packaging of claim 7, wherein the container comprises a neck spaced to the opening of the container, wherein a flow cross-section of the neck is closable by a plug, wherein the cap further comprises a rib for pushing the plug out of the neck, wherein the mainly tubular skirt of the cap is arranged radially outside the container and the rib is arranged radially inside the container.

10. The packaging of claim 9, wherein a second fluid is provided inside the container, wherein the second fluid is arranged such that the second fluid is spaced to the first fluid by the plug.

11. A cap for closing an opening of at least one container, the cap comprising:

a mainly tubular skirt that comprises a bayonet notch for guiding a pin of a container, wherein the bayonet notch is L-shaped for providing a mainly axial relative movement of the cap relative to the container by means of a first part of the bayonet notch and a turning of the cap relative to the container by means of a second part of the bayonet notch, wherein the mainly tubular skirt further comprises a first guiding rim running in an axial direction and in a circumferential direction towards the bayonet notch for guiding the pin of the container into the bayonet notch, wherein at least one of the first guiding rim and a second guiding rim runs from the bayonet notch to an axial stop rim or from the bayonet notch to a circumferential stop rim, wherein the circumferential stop rim is provided by means of an axially running rib comprising an extension in the circumferential direction that is smaller than an extension in the circumferential direction of the pin.

12. A cap for closing an opening of at least one container, the cap comprising:

a mainly tubular skirt that comprises a bayonet notch for guiding a pin of a container, wherein the bayonet notch is L-shaped for providing a mainly axial relative movement of the cap relative to the container by means of a first part of the bayonet notch and a turning of the cap relative to the container by means of a second part of the bayonet notch, wherein the mainly tubular skirt further comprises a first guiding rim running in an axial direction and in a circumferential direction towards the bayonet notch for guiding the pin of the container into the bayonet notch, wherein the first guiding rim is provided by a difference in a wall thickness of the mainly tubular skirt, wherein a whole area of the mainly tubular skirt, between the first guiding rim and a bottom side of the mainly tubular skirt, comprises a wall thickness that is less than a wall thickness of an area of the mainly tubular skirt between the first guiding rim and a top side of the mainly tubular skirt.

* * * * *